US006796639B2

(12) United States Patent
Sugahara

(10) Patent No.: US 6,796,639 B2
(45) Date of Patent: Sep. 28, 2004

(54) INKJET PRINT HEAD

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/265,731

(22) Filed: Oct. 8, 2002

(65) Prior Publication Data

US 2003/0067515 A1 Apr. 10, 2003

(30) Foreign Application Priority Data

Oct. 9, 2001 (JP) ..... 2001-311726

(51) Int. Cl.[7] ..... B41J 2/045

(52) U.S. Cl. ..... 347/71

(58) Field of Search ..... 347/68, 70, 71, 347/72; 29/890.1, 25.35; 310/328

(56) References Cited

U.S. PATENT DOCUMENTS 6,003,968 A * 12/1999 Kozawa ..... 347/20

FOREIGN PATENT DOCUMENTS

| | | |
|---|---|---|
| JP | A 6-87213 | 3/1994 |
| JP | A 9-99557 | 4/1997 |

* cited by examiner

*Primary Examiner*—Judy Nguyen
(74) *Attorney, Agent, or Firm*—Oliff & Berridge, PLC

(57) ABSTRACT

An inkjet print head includes a piezoelectric actuator plate and first through third ink channel plates, which are stacked and bonded together by a thermo-setting adhesive. The piezoelectric actuator plate is made of a material (such as lead zirconate titanate) that has a linear expansion coefficient smaller than those of the first through third ink channel plates. The piezoelectric actuator plate is bonded to the first ink channel plate, which is formed of a material (aluminum alloy, for example) having the linear expansion coefficient larger than those of the second and third ink channel plates. The second and third ink channel plates are formed of ferritic stainless steel or the like, and are stacked on the bottom of the first ink channel plate. No warping or deformation occurs in the overall inkjet print head when the print head is returned to room temperature after the adhesive bonding process. The plates in the inkjet print head are formed of materials that have good resistance to the corrosion of ink, thereby increasing the life of the inkjet print head.

19 Claims, 4 Drawing Sheets

FIG.4

| PIEZOELECTRIC ACTUATOR PLATE 10 THICKNESS 75 μm | |
|---|---|
| MATERIAL | LINEAR EXPANSION COEFFICIENT [/°C] |
| LEAD ZIRCONATE TITANATE | $1 \times 10^{-6}$ |

| FIRST INK CHANNEL PLATE 11 THICKNESS 75 μm | | SECOND INK CHANNEL PLATE 12 THICKNESS 75 μm | | THIRD INK CHANNEL PLATE 13 THICKNESS 150 μm | | STATE OF WARPING AFTER BONDING |
|---|---|---|---|---|---|---|
| MATERIAL | LINEAR EXPANSION COEFFICIENT [/°C] | MATERIAL | LINEAR EXPANSION COEFFICIENT [/°C] | MATERIAL | LINEAR EXPANSION COEFFICIENT [/°C] | |
| ALLUMINUM ALLOY | $23 \times 10^{-6}$ | AUSTENITIC STAINLESS STEEL | $17 \times 10^{-6}$ | AUSTENITIC STAINLESS STEEL | $17 \times 10^{-6}$ | A GENTLE WARPING OCCURS, BUT THERE IS NO FUNCTIONAL PROBLEM. |
| ALLUMINUM ALLOY | $23 \times 10^{-6}$ | FERRITIC STAINLESS STEEL | $10 \times 10^{-6}$ | FERRITIC STAINLESS STEEL | $10 \times 10^{-6}$ | NO WARPING OCCURS |
| AUSTENITIC STAINLESS STEEL | $17 \times 10^{-6}$ | FERRITIC STAINLESS STEEL | $10 \times 10^{-6}$ | FERRITIC STAINLESS STEEL | $10 \times 10^{-6}$ | NO WARPING OCCURS |
| AUSTENITIC STAINLESS STEEL | $17 \times 10^{-6}$ | TITANIUM ALLOY | $8 \times 10^{-6}$ | TITANIUM ALLOY | $8 \times 10^{-6}$ | NO WARPING OCCURS |
| AUSTENITIC STAINLESS STEEL | $17 \times 10^{-6}$ | FERRITIC STAINLESS STEEL | $10 \times 10^{-6}$ | TITANIUM ALLOY | $8 \times 10^{-6}$ | NO WARPING OCCURS |
| AUSTENITIC STAINLESS STEEL | $17 \times 10^{-6}$ | TITANIUM ALLOY | $8 \times 10^{-6}$ | FERRITIC STAINLESS STEEL | $10 \times 10^{-6}$ | NO WARPING OCCURS |
| AUSTENITIC STAINLESS STEEL | $17 \times 10^{-6}$ | TITANIUM ALLOY | $8 \times 10^{-6}$ | GLASS | $8 \times 10^{-6}$ | NO WARPING OCCURS |
| AUSTENITIC STAINLESS STEEL | $17 \times 10^{-6}$ | GLASS | $8 \times 10^{-6}$ | TITANIUM ALLOY | $8 \times 10^{-6}$ | NO WARPING OCCURS |

INKJET PRINT HEAD

BACKGROUND OF THE INVENTION

1. Field of the Invention

The present invention relates to an inkjet print head, and particularly to an inkjet print head including stacked piezoelectric actuator plates and a plurality of ink channel plates.

2. Description of Related Art

Inkjet printers equipped with inkjet print heads for printing on paper or other recording media are well known in the art.

FIG. 1 shows an inkjet head 145 employed in this type of inkjet printer. The inkjet head 145 includes a piezoelectric actuator plate 150 and a plurality of thin metal plates 160. The piezoelectric actuator plate 150 is formed of a ceramic material. The piezoelectric actuator plate 150 and the metal plates 160 are stacked together and bonded with a thermo-setting adhesive. Ink channels 165 are formed in the metal plates 160 through an etching process.

SUMMARY OF THE INVENTION

The piezoelectric actuator plate 150 and metal plates 160 are stacked together with interposing thermo-setting adhesive and bonded together by applying heat and pressure. The metal material in the metal plates 160 generally has a larger linear expansion coefficient than the piezoelectric actuator plate 150. Accordingly, the metal plates 160 expand to a larger degree than the piezoelectric actuator plate 150 due to the heat. When the temperature of the metal plates 160 returns to room temperature after the bonding process, the metal plates 160 contract much more than the piezoelectric actuator plate 150. As a result, the inkjet head 145 can warp into a convex shape swelling toward the piezoelectric actuator plate 150 end, as indicated by the broken line in FIG. 1. This warping can cause damage to the piezoelectric actuator plate 150, which is formed of a ceramic material.

To prevent this, a method is conceivable to construct the metal plates 160 using metal plates (for example, Ni 42%-Fe alloy) having a relatively small linear expansion coefficient. By minimizing the difference between linear expansion coefficients of the piezoelectric actuator plate 150 and the metal plates 160, it is possible to reduce the difference in amount of deformation, or shrinkage, in the piezoelectric actuator plate 150 and the metal plates 160 when the inkjet head 145 cools after the bonding process.

However, the metal plates 160 used in this conceivable method are formed of metal plates having a relatively small linear expansion coefficient that is generally not resistant to the corrosiveness of ink. As a result, the lifespan of the inkjet head 145 is shortened.

On the other hand, metal plates that are superior in resistance to ink corrosion generally have a high linear expansion coefficient. As a result, the inkjet head 145 becomes warped or damaged after bonding, as described above, leading to a low yield in the manufacturing process.

In view of the above-described drawbacks, it is an objective of the present invention to provide an improved inkjet print head, in which channels are formed in ink channel plates that are superior in the resistance of ink corrosion, and which is capable of preventing deformation of these plates after bonding.

In order to attain the above and other objects, the present invention provides an inkjet print head, comprising: a piezoelectric actuator plate for being driven by a drive voltage; first and second ink channel plates, each being formed with a plurality of ink channels for guiding ink, the first and second ink channel plates being stacked one on the other, the first ink channel plate having a linear expansion coefficient greater than linear expansion coefficients of the second ink channel plate and the piezoelectric actuator plate; and a thermo-setting adhesive layer provided, between the piezoelectric actuator and the first ink channel plate, for bonding the piezoelectric actuator plate to the first ink channel plate.

In the inkjet print head described above, the linear expansion coefficient of the material used to form the first ink channel plate is larger than those of the other plates (piezoelectric actuator plate and second ink channel plate). Accordingly, the first ink channel plate interposed between the piezoelectric actuator plate and the second ink channel plate has the largest amount of deformation and shrinkage that occurs when the plates cool after the piezoelectric actuator plate is bonded to the first ink channel plate using a thermo-setting adhesive. While warping forces act on the plates on both sides of the first ink channel plate, these forces act in opposing directions and substantially cancel each other. Hence, it is possible to prevent the inkjet head from becoming extremely warped and damaged, thereby leading to high yields in the manufacturing process.

BRIEF DESCRIPTION OF THE DRAWINGS

The above and other objects, features and advantages of the invention will become more apparent from reading the following description of the preferred embodiments taken in connection with the accompanying drawings in which:

FIG. 4 is a table showing several combinations of materials for the piezoelectric actuator plate and ink channel plates according to the present embodiment.

DETAILED DESCRIPTION OF THE PREFERRED EMBODIMENT

Figure 1:
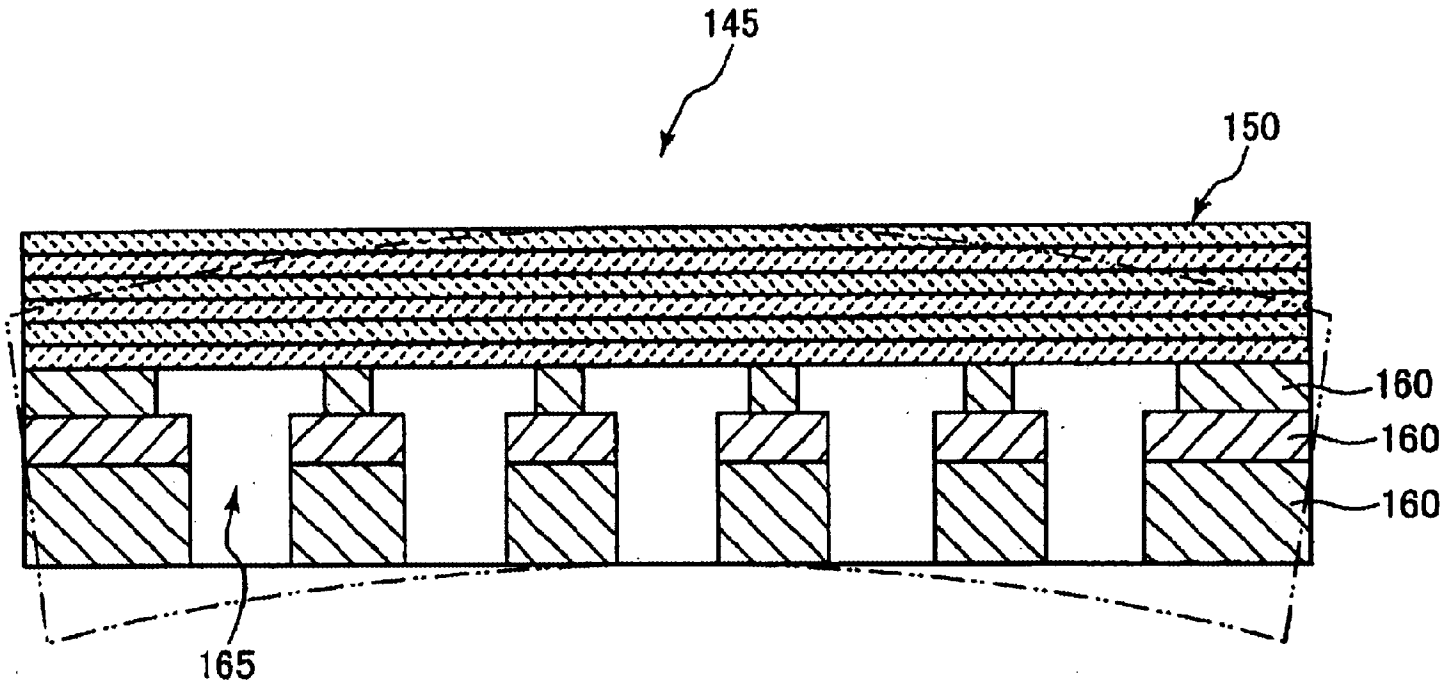
PRIOR ART FIG.1
FIG. 1 is a cross-sectional view taken along a line approximately orthogonal to the lengthwise direction of a conventional inkjet head.

An inkjet print head according to a preferred embodiment of the present invention will be described while referring to the accompanying drawings wherein like parts and components are designated by the same reference numerals to avoid duplicating description.

An inkjet print head according to a preferred embodiment of the present invention will be described while referring to FIGS. 2–4.

Figure 2:
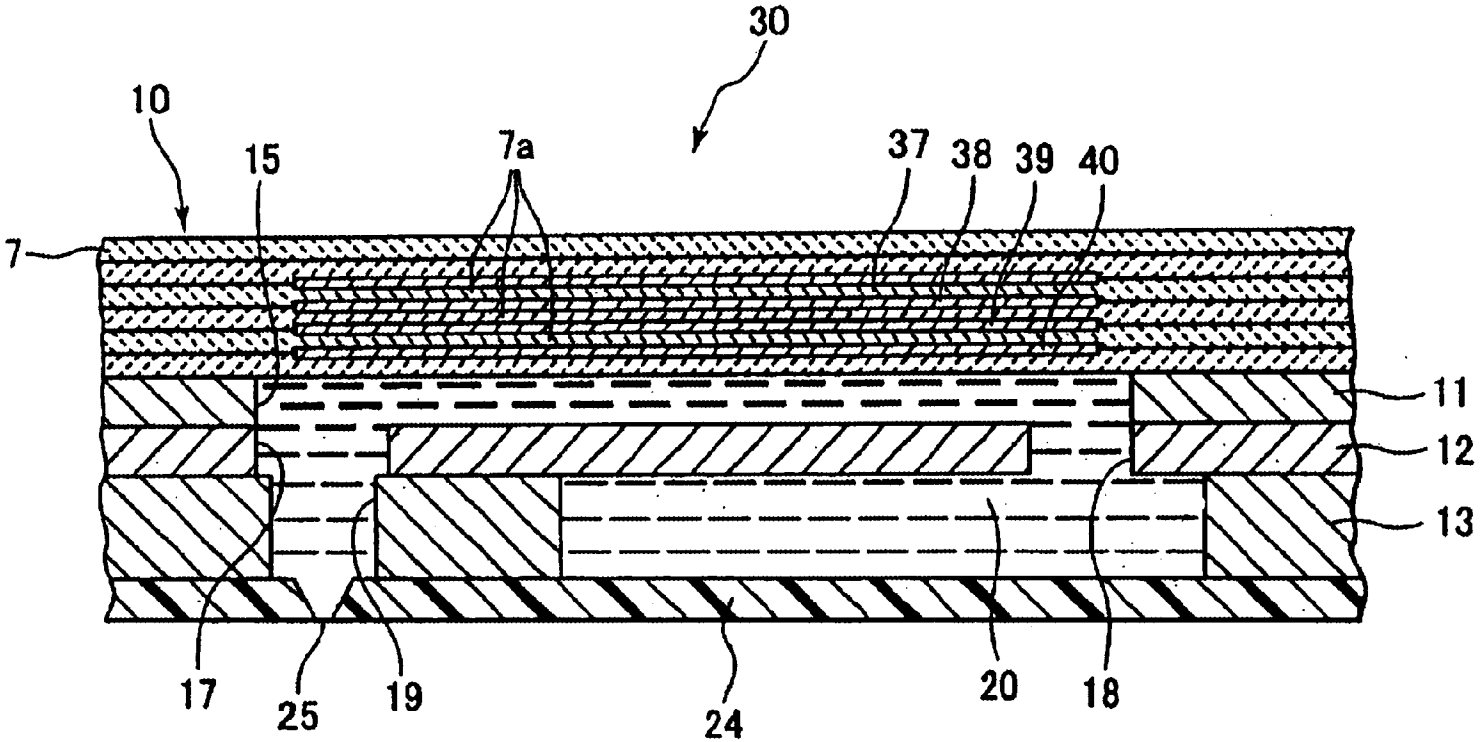
FIG. 2 is a cross-sectional view taken along a line approximately parallel to the lengthwise direction of an inkjet print head according to a preferred embodiment of the present invention.

FIG. 2 shows the construction of an inkjet print head 30 according to the present embodiment. The inkjet print head 30 includes: a first ink channel plate 11, a second ink channel plate 12, and a third ink channel plate 13, which are stacked together from top to bottom, as shown in FIG. 2. In this example, the ink channel plates 11, 12, and 13 are thin metal plates formed in a rectangular shape, and are formed with ink channels as will be described later. In the inkjet print head 30, a piezoelectric actuator plate 10 is provided on top of the first ink channel plate 11. The piezoelectric actuator plate 10, the first ink channel plate 11, and the second ink channel plate 12 are each formed at a thickness of approximately 75 μm, while the third ink channel plate 13 has a thickness of approximately 150 μm. The material forming each plate is described later.

In the inkjet print head 30, a nozzle plate 24 is provided on the bottom of the third ink channel plate 13. The nozzle plate 24 is made of a synthetic resin, such as polyimide, and is formed with a plurality of nozzles 25 for ejecting ink. In this way, five plates 10, 11–13, and 24 are stacked vertically.

The plates 10, 11–13, and 24 are bonded together by an epoxy type thermo-setting adhesive. A drive circuit (not shown) generates a drive voltage. A flexible wiring board (not shown) is bonded to the top surface of the piezoelectric actuator plate 10. The flexible wiring board applies the drive voltage to the piezoelectric actuator plate 10.

Figure 3:
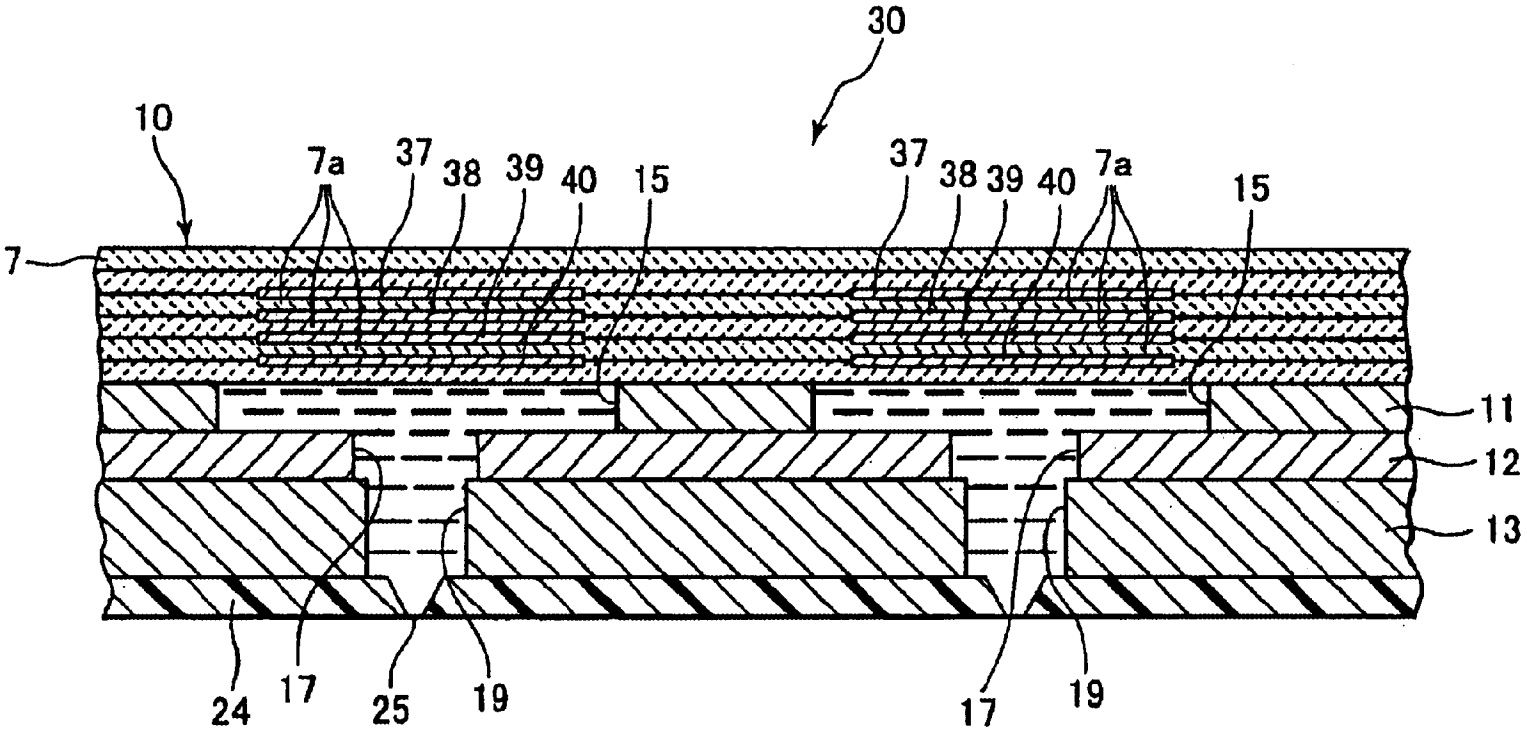
FIG. 3 is a cross-sectional view taken along a line approximately orthogonal to the lengthwise direction of the inkjet print head of FIG. 2.

As shown in FIGS. 2 and 3, the first ink channel plate 11 is formed with a plurality of pressure chambers 15. The pressure chambers 15 are arranged on a single plane with their lengthwise directions being parallel to one another.

A plurality of through-holes 17 are formed in the second ink channel plate 12. Each through-hole 17 is in fluid communication with one end of a corresponding pressure chamber 15. Another plurality of through-holes 18 are formed in the second ink channel plate 12. Each through-hole 18 is in fluid communication with the other end of a corresponding pressure chamber 15.

A plurality of through-holes 19 are formed in the third ink channel plate 13. Each through-hole 19 is in fluid communication with a corresponding through-hole 17 and with a corresponding nozzle 25. In this way, the through-holes 17 and 19 provide fluid communication between the pressure chambers 15 and the nozzles 25.

A manifold 20 is formed in the third ink channel plate 13. The manifold 20 is disposed beneath the row of pressure chambers 15 and extends in the same direction as the row of pressure chambers 15. Each through-hole 18 is in fluid communication with the manifold 20, and provides fluid communication between a corresponding pressure chamber 15 and the manifold 20. One end of the manifold 20 is connected to an ink supply source (not shown). In this way, the manifold supplies ink to each pressure chamber 15 via the corresponding through-hole 18.

Thus, the manifold 20, through-holes 18, pressure chambers 15, through-holes 17, through-holes 19, and nozzles 25 form the ink channels.

The piezoelectric actuator plate 10 is formed of a piezoelectric ceramic material, such as lead zirconate titanate (PZT) ceramic material. The piezoelectric actuator plate 10 includes: a plurality of piezoelectric ceramic layers 7; and a plurality of internal electrodes 37, 38, 39, and 40 interposed between the piezoelectric ceramic layers 7. Each piezoelectric ceramic layer 7 has a piezoelectric and electrostrictive effect. The piezoelectric actuator plate 10 extends along all the pressure chambers 15. The internal electrodes 37, 38, 39, and 40 are disposed in positions corresponding to the respective pressure chambers 15. The portions 7*a* of the piezoelectric ceramic layers 7 that are interposed between the internal electrodes 37, 38, 39, and 40 (hereinafter referred to as activation portions) are polarized according to a well known polarization process. Accordingly, the activation portions 7*a* of the piezoelectric ceramic layers 7 will expand in the stacking direction of the ceramic layers 7 when a voltage in the same direction as the polarization direction is applied to the internal electrodes 37, 38, 39, and 40. Voltages are selectively applied to the electrodes for desired pressure chambers 15 in order to eject ink stored in desired pressure chambers 15.

In the inkjet print head 30 having the construction described above, the ink channel plates 11 through 13 and the nozzle plate 24 are stacked one on another and bonded together via interposing thermo-setting adhesive. The piezoelectric actuator plate 10 is stacked on top of the first ink channel plate 11 and bonded to the first ink channel plate 11 with an interposing thermo-setting adhesive.

It is noted that the heat and pressure applied to these layers causes the ink channel plates 11–13 to expand in a greater degree than the piezoelectric actuator plate 10 due to the difference between linear expansion coefficients of the metal material forming the ink channel plates 11–13 and of the ceramic material forming the piezoelectric actuator plate 10. When the plates are cooled after adhesions the ink channel plates 11–13 shrink much more than the piezoelectric actuator plate 10. As a result, the overall inkjet print head 30 will become deformed. Due to the combination of materials of the ink channel plates 11–13, extreme warping and deformation may possibly occur in the inkjet print head 30, potentially causing damage to the same.

It is conceivable to form the ink channel plates 11–13 with a material having a small linear expansion coefficient, in order to satisfy only one requirement that the amount of deformation due to the temperature changes has to be minimized. In this case, it is possible to suppress deformation of the inkjet print head 30. However, such a material is generally inferior in its ability to withstand ink corrosion. As a result, the lifespan of the inkjet print head 30 will be shortened Taking into account the above-described problems, according to the present embodiment, deformation of the inkjet print head 30 is minimized by skillfully combining linear expansion coefficients of a plurality of materials that have good resistance to ink corrosion.

It is noted that as described already, the piezoelectric actuator plate 10, first ink channel plate 11, and second ink channel plate 12 each have a thickness of 75 μm, while the third ink channel plate 13 has a thickness of 150 μm. The piezoelectric actuator plate 10 is made of lead zirconate titanate, whose linear expansion coefficient is equal to $1\times10^{-6}/°$ C.

According to the present embodiment, material for each ink channel plate 11–13 is selected from among materials, such as austenitic stainless steel, titanium alloy, aluminum alloy, glass, and the like, that have good resistance to ink corrosion in order to lengthen the lifespan of the inkjet print head 30.

The materials forming the ink channel plates 11–13 are selected so that the linear expansion coefficient of the piezoelectric actuator plate 10 is smaller than those of the ink channel plates 11–13 and so that the linear expansion coefficient of the first ink channel plate 11 is greater than those of the other plates 10, 12, and 13.

The first ink channel plate 11 is positioned directly below the piezoelectric actuator plate 10. In other words, the first ink channel plate 11 is positioned between the piezoelectric actuator plate 10 and the second and third ink channel plates 12–13. Because the linear expansion coefficient of the first ink channel plate 11 is greater than those of the other plates 10, 12, and 13, the first ink channel plate 11 contracts more than the piezoelectric actuator plate 10 and the ink channel plates 12–13 when returning to a room temperature after the plates are bonded by a thermo-setting adhesive. The piezoelectric actuator plate 10 and the ink channel plates 12–13 are located on the opposite sides of the first ink channel plate 11, respectively. Accordingly, the force for warping the piezoelectric actuator plate 10 and the force for warping the ink channel plates 12–13 are generated on the opposite sides of the first ink channel plate 11 in opposing directions. Therefore, the forces substantially cancel each other, preventing the overall inkjet print head 30 from warping and becoming deformed.

The linear expansion coefficient of the first ink channel plate 11 is preferably about 1.3 times or more as large as the linear expansion coefficient of each of the second ink channel plate 12 and the third ink channel plate 13. In other words, it is preferable that the linear expansion coefficient of the ink channel plate 11 is substantially greater than or equal to a product of the linear expansion coefficient of the ink channel plate 12 and the value of 1.3 and that the linear expansion coefficient of the ink channel plate 11 is substantially greater than or equal to a product of the linear expansion coefficient of the ink channel plate 13 and the value of 1.3.

More preferably, the linear expansion coefficient of the first ink channel plate 11 is preferably about 1.7 times or more as large as the linear expansion coefficient of each of the second ink channel plate 12 and third ink channel plate 13. In other words, it is more preferable that the linear expansion coefficient of the ink channel plate 11 is substantially greater than or equal to a product of the linear expansion coefficient of the ink channel plate 12 and the value of 1.7 and that the linear expansion coefficient of the ink channel plate 11 is substantially greater than or equal to a product of the linear expansion coefficient of the ink channel plate 13 and the value of 1.7.

Next, examples of the plate materials for the ink channel plates 11–13 will be described with reference to FIG. 4. It is noted that the piezoelectric actuator plate 10 is made of lead zirconate titanate with linear expansion coefficient of $1\times10^{-6}$/° C.

In a first example, the ink channel plate 11 is made of an aluminum alloy (linear expansion coefficient=$23\times10^{-6}$/° C), the ink channel plate 12 is made of austenitic stainless steel (linear expansion coefficient=$17\times10^{-6}$/° C.), and the ink channel plate 13 is also made of austenitic stainless steel. In this case, a gentle warping occurs in a resultant inkjet print head 30 when the temperature drops after the plates are bonded with a thermo-setting adhesive. However, the inkjet print head 30 has no functional problems.

In a second example, the ink channel plate 11 is made of an aluminum alloy (linear expansion coefficient=$23\times10^{-6}$/° C.), the ink channel plate 12 is made of ferritic stainless steel (linear expansion coefficient=$10\times10^{-6}$/° C.), and the ink channel plate 13 is also made of ferritic stainless steel. In this case, warping does not occur in the inkjet print head 30 after the plates are bonded with a thermo-setting adhesive, and a satisfactory inkjet print head 30 can be formed without problem.

In a third example, the ink channel plate 11 is made of an austenitic stainless steel (linear expansion coefficient $17\times10^{-6}$/° C.), the ink channel plate 12 is made of ferritic stainless steel (linear expansion coefficient=$10\times10^{-6}$/° C.), and the ink channel plate 13 is made of ferritic stainless steel. In this case, no warping occurs in the inkjet print head 30 and a satisfactory inkjet print head 30 can be formed.

Similarly, in a fourth example, the ink channel plate 11 is made of austenitic stainless steel (linear expansion coefficient $17\times10^{6}$/° C.), the ink channel plate 12 is made of titanium alloy ($8\times10^{-6}$/° C.), and the ink channel plate 13 is made of titanium alloy. Also in this case, no warping occurs in the inkjet print head 30 and a satisfactory inkjet print head 30 can be formed.

In a fifth example, the ink channel plate 11 is made of an austenitic stainless steel (linear expansion coefficient=$17\times10^{-6}$/° C.), the ink channel plate 12 is made of ferritic stainless steel (linear expansion coefficient $10\times10^{-6}$/° C.), and the ink channel plate 13 is made of titanium alloy ($8\times10^{-6}$/° C.). Also in this case, no warping occurs in the inkjet print head 30 and a satisfactory inkjet print head 30 can be formed.

In a sixth example, the ink channel plate 11 is made of an austenitic stainless steel (linear expansion coefficient=$17\times10^{-6}$/° C.), the ink channel plate 12 is made of titanium alloy ($8\times10^{-6}$/° C.), and the ink channel plate 13 is made of ferritic stainless steel (linear expansion coefficient=$10\times10^{-6}$/° C.). The sixth example is obtained by exchanging the materials (ferritic stainless steel and titanium alloy) for the second ink channel plate 12 and the third ink channel plate 13 in the fifth example. Also in this case, a satisfactory inkjet head can be obtained in the same way as in the fifth example.

In a seventh example, the ink channel plate 11 is made of an austenitic stainless steel (linear expansion coefficient=$17\times10^{-6}$/° C.), the ink channel plate 12 is made of titanium alloy (linear expansion coefficient=$8\times10^{-6}$/° C.), and the ink channel plate 13 is made of glass (linear expansion coefficient=$8\times10^{-6}$/° C.). Also in this case, no warping occurs in the inkjet print head 30 and a satisfactory inkjet print head 30 can be formed. It is noted that because glass is a ceramic material, it is obvious that the same effects can be obtained by replacing glass with other ceramic material.

In an eighth example, the ink channel plate 11 is made of an austenitic stainless steel (linear expansion coefficient=$17\times10^{-6}$/° C.), the ink channel plate 12 is made of glass (linear expansion coefficient=$8\times10^{-6}$/° C.), and the ink channel plate 13 is made of titanium alloy (linear expansion coefficient=$8\times10^{-6}$/° C.). The eighth example is obtained by exchanging the materials (titanium alloy and glass) for the second ink channel plate 12 and the third ink channel plate 13 in the seventh example. Also in this case, a satisfactory inkjet head can be obtained. It is noted that because glass is a ceramic material, it is obvious that the same effects can be obtained by replacing glass with other ceramic material.

In this way, in all the examples described above, the linear expansion coefficient of the piezoelectric actuator plate 10 is sufficiently smaller than those of the other plates 11–13. The linear expansion coefficient of the first ink channel plate 11 is sufficiently greater than those of the other plates 10, 12, and 13. Accordingly, the resultant inkjet print heads 30 suffer from no functional problems.

As described above, according to the present embodiment, the inkjet print head 30 includes the several plates 10, 11, 12, and 13, which are stacked and bonded together by a thermo-setting adhesive. The piezoelectric actuator plate 10 is bonded to the first ink channel plate 11. The second and third ink channel plates 12 and 13 are stacked on the bottom of the first ink channel plate 11. The piezoelectric actuator plate 10 is made of material, such as lead zirconate titanate, that has the smallest linear expansion coefficient among all the plates 10, 11, 12, and 13. The plates 11–13 in the inkjet print head 30 are formed of materials that have good resistance to the corrosion of ink. It is possible to increase the life of the inkjet print head 30. It is unnecessary to replace the inkjet print head 30 with new ones frequently. The material of the first ink channel plate 11 is aluminum alloy, for example, that has the largest linear expansion coefficient among all the plates 10, 11, 12, and 13. The materials of the second and third ink channel plates 12 and 13 are ferritic stainless steel or the like. Accordingly, no warping or deformation occurs in the overall inkjet print head 30 when the print head 30 is returned to a room temperature after the adhesive bonding process.

It is noted that according to the above-described embodiment, the nozzle plate 24 is made of polyimide (synthetic resin) having a linear expansion coefficient of 10 about 12 to $25\times10^{-6}/°$ C. Accordingly, it can be said that the piezoelectric actuator plate 10 is made of a material (such as lead zirconate titanate) that has the smallest linear expansion coefficient among all the plates 10, 11, 12, 13, and 24 constituting the inkjet print head 30. When the linear expansion coefficient of the nozzle plate 24 is smaller than that of the first ink channel plate 11, it can be said that the first ink channel plate 11 is formed of a material (aluminum alloy, for example) that has the largest linear expansion coefficient among all the plates 10, 11, 12, 13, and 24.

While the invention has been described in detail with reference to the specific embodiment thereof, it would be apparent to those skilled in the art that many modifications and variations may be made therein without departing from the spirit of the invention, the scope of which is defined by the attached claims.

For example, in the seventh and eighth examples in the table of FIG. 4, the second ink channel plate 12 and the third ink channel plate 13 are made of titanium alloy or glass, while the first ink channel plate 11 is formed of an austenitic stainless steel. However, it is possible to form the second ink channel plate 12 and the third ink channel plate 13 of titanium alloy or glass, while the first ink channel plate 11 is formed of an aluminum alloy. More specifically, such a combination can be employed, in which the plates 11–13 are made of an aluminum alloy, titanium alloy, and glass, respectively. Another combination can be employed, in which the plates 11–13 are made of an aluminum alloy, glass, and titanium alloy, respectively.

In all the first through six examples in the table of FIG. 4, the ink channel plate 11 is made of metal. In the first through six examples in FIG. 4, both the ink channel plates 12 and 13 are made of metal. In the seventh and eighth examples and in the above-described modifications, one of the ink channel plates 12 and 13 is made of metal and the other one of the ink channel plates 12 and 13 is made of ceramic, such as glass. However, both of the ink channel plates 12 and 13 may be made of ceramic such as glass. For example, such a combination can also be employed, in which the ink channel plate 11 is formed of an aluminum alloy or austenitic stainless steel, and both of the plates 12 and 13 are made of glass or other ceramic.

Each ink channel plate 11–13 need not be limited to metal or ceramic but can be formed of other material such as a resin or the like, provided that the material has good resistance to ink corrosion and that the linear expansion coefficient of the ink channel plate 11 is greater than those of the other plates 10, 12, and 13.

The number of the ink channel plates in the present invention is not limited to three plates, as described in the present embodiment, but can be two, four, or a greater number of plates. For example, the second ink channel plate 12 and the third ink channel plate 13 may be formed integrally. For example, the manifold 20 and the through-holes 17, 18, and 19 are formed in the single second ink channel plate 12. The third ink channel plate 13 is omitted from the inkjet print head 30.

The piezoelectric actuator plate is not limited to the type that expands in the stacking direction, but may be of a unimorph or bimorph type that bends outward from the surface of the plate or a type that deforms in shear mode.

Further, the piezoelectric actuator plate is not limited to a stacked type, but may also be formed as an integral plate.

The material of the piezoelectric actuator plate 10 is not limited to lead zirconate titanate. The piezoelectric actuator plate 10 may be formed of any other piezoelectric material, provided that the linear expansion coefficient of the piezoelectric material is smaller than that of the first ink channel plate 11. It is preferable that the linear expansion coefficient of the piezoelectric material is smaller than those of all the first through third ink channel plates 11–13.

The material of the nozzle plate 24 is not limited to synthetic resin such as polyimide. The nozzle plate 24 may be formed of any other material. When the nozzle plate 24 is formed of metal, for example, the linear expansion coefficient of the nozzle plate 24 might possibly be smaller than that of the piezoelectric actuator plate 10.

What is claimed is:

1. An inkjet print head, comprising:

a piezoelectric actuator plate for being driven by a drive voltage;

first and second ink channel plates, each being formed with a plurality of ink channels for guiding ink, the first and second ink channel plates being stacked one on the other, the first ink channel plate being located between the piezoelectric actuator plate and the second ink channel plate and the first ink channel plate having a linear expansion coefficient greater than linear expansion coefficients of the second ink channel plate and the piezoelectric actuator plate; and a thermo-setting adhesive layer provided, between the piezoelectric actuator and the first ink channel plate, for bonding the piezoelectric actuator plate to the first ink channel plate.

2. An inkiet print head as recited in claim 1, wherein the linear expansion coefficient of the first ink channel plate is substantially greater than or equal to a product of the linear expansion coefficient of the second ink channel plate and the value of 1.3.

3. An inkjet print head as recited in claim 2, wherein the linear expansion coefficient of the first ink channel plate is substantially greater than or equal to a product of the linear expansion coefficient of the second ink channel plate and the value of 1.7.

4. An inkjet print head as recited in claim 1, wherein the linear expansion coefficient of the piezoelectric actuator plate is smaller than the linear expansion coefficients of the first and second ink channel plates.

5. An inkjet print head as recited in claim 1, wherein the first ink channel plate is formed with a plurality of pressure chambers, which are arranged along a single plane to accommodate ink therein and which are used for selective ejection, and wherein the piezoelectric actuator plate spans across the plurality of pressure chambers and has a plurality of activation portions for being selectively driven to apply pressure to the respective pressure chambers, thereby causing eject ink to be ejected from the pressure chambers.

6. An inkjet print head as recited in claim 5, wherein the second ink channel plate has a pair of opposite sides, the first ink channel plate being provided on one side of the second ink channel plate, further comprising a third ink channel plate provided on the other side of the second ink channel plate, and wherein the third ink channel plate being formed with a manifold for supplying ink to the plurality of pressure chambers, the second ink channel plate being formed with a plurality of through-holes for communicating the manifold to the plurality of pressure chambers, the linear expansion coefficient of the third ink channel plate being smaller than the linear expansion coefficient of the first ink channel plate.

7. An inkjet print head as recited in claim 6, wherein the first through third ink channel plates are formed of a material that is resistant to ink corrosion.

8. An inkjet print head as recited in claim 6, wherein the first ink channel plate is formed of a metal material, and each of the second and third ink channel plates is formed of either one of a metal material and a ceramic material.

9. An inkjet print head as recited in claim 8, wherein the first ink channel plate is formed of a metal material, the second ink channel plate is formed of a metal material, and the third ink channel plate is formed of a ceramic material.

10. An inkiet print head as recited in claim 8, wherein the first ink channel plate is formed of a metal material, the second ink channel plate is formed of a ceramic material, and the third ink channel plate is formed of a metal material.

11. An inkjet print head as recited in claim 8, wherein the first ink channel plate is formed of a metal material, both of the second and third ink channel plates are formed of a metal material.

12. An inkjet print head as recited in claim 6, wherein the piezoelectric actuator plate is made of lead zirconate titanate, the first ink channel plate is formed of an aluminum alloy, the second ink channel plate is made of austenitic stainless steel, and the third ink channel plate is made of an austenitic stainless steel.

13. An inkjet print head as recited in claim 6, wherein the piezoelectric actuator plate is made of lead zirconate titanate, the first ink channel plate is formed of an aluminum alloy, the second ink channel plate is made of ferritic stainless steel, and the third ink channel plate is made of ferritic stainless steel.

14. An inkjet print head as recited in claim 6, wherein the piezoelectric actuator plate is made of lead zirconate titanate, the first ink channel plate is formed of an austenitic stainless steel, the second ink channel plate is made of ferritic stainless steel, and the third ink channel plate is made of ferritic stainless steel.

15. An inkjet print head as recited in claim 6, wherein the piezoelectric actuator plate is made of lead zirconate titanate, the first ink channel plate is formed of an austenitic stainless steel, the second ink channel plate is made of titanium alloy, and the third ink channel plate is made of titanium alloy.

16. An inkjet print head as recited in claim 6, wherein the piezoelectric actuator plate is made of lead zirconate titanate, the first ink channel plate is formed of an austenitic stainless steel, the second ink channel plate is made of ferritic stainless steel, and the third ink channel plate is made of titanium alloy.

17. An inkjet print head as recited in claim 6, wherein the piezoelectric actuator plate is made of lead zirconate titanate, the first ink channel plate is formed of an austenitic stainless steel, the second ink channel plate is made of titanium alloy, and the third ink channel plate is made of ferritic stainless steel.

18. An inkjet print head as recited in claim 6, wherein the piezoelectric actuator plate is made of lead zirconate titanate, the first ink channel plate is formed of an austenitic stainless steel, the second ink channel plate is made of titanium alloy, and the third ink channel plate is made of glass.

19. An inkjet print head as recited in claim 6, wherein the piezoelectric actuator plate is made of lead zirconate titanate, the first ink channel plate is formed of an austenitic stainless steel, the second ink channel plate is made of glass, and the third ink channel plate is made of titanium alloy.

* * * * *